US010024584B1

(12) United States Patent
Peet

(10) Patent No.: US 10,024,584 B1
(45) Date of Patent: Jul. 17, 2018

(54) COOLED CABINET ASSEMBLY

(76) Inventor: Jason N. Peet, Fredericksburg, TX (US)

( * ) Notice: Subject to any disclaimer, the term of this patent is extended or adjusted under 35 U.S.C. 154(b) by 1868 days.

(21) Appl. No.: 13/136,388

(22) Filed: Jul. 29, 2011

(51) Int. Cl.
*F25B 21/02* (2006.01)
*F28D 21/00* (2006.01)

(52) U.S. Cl.
CPC ..... *F25B 21/02* (2013.01); *F28D 2021/0077* (2013.01)

(58) Field of Classification Search
CPC ..... B65D 25/108; A61B 50/33
USPC ..... 62/3.62, 457, 457.2, 3.3, 3.6, 371; 435/290; 165/27, 48.1
See application file for complete search history.

(56) References Cited

U.S. PATENT DOCUMENTS 2,641,368 A 6/1953 Brown
2,695,729 A 11/1954 Hornish
3,625,485 A 12/1971 Adler
3,696,632 A * 10/1972 Carlin et al. ..... 62/285
3,832,862 A 9/1974 Ingels
3,922,879 A 12/1975 Arnold
3,940,249 A 2/1976 McClurg
4,310,047 A 1/1982 Branson
4,335,630 A 6/1982 Adams
4,364,234 A * 12/1982 Reed ..... F25B 21/02 165/265
4,599,314 A * 7/1986 Shami ..... B01L 3/50853 206/509
4,679,615 A 7/1987 Livne
4,850,484 A 7/1989 Denman
4,950,608 A 8/1990 Kishimoto
5,029,446 A * 7/1991 Suzuki ..... 62/3.6
5,127,064 A 6/1992 Flinois et al.
5,217,064 A * 6/1993 Kellow ..... A61J 1/165 165/254
5,609,826 A * 3/1997 Cargill ..... B01J 19/0046 422/527
5,661,978 A 9/1997 Holmes et al.
5,665,762 A 9/1997 Carroll et al.
(Continued)

OTHER PUBLICATIONS

Torrey Pines, Scientific, Inc., 2006 Product Catalog, Feb. 16, 2006.
(Continued)

*Primary Examiner* — Emmanuel Duke
(74) *Attorney, Agent, or Firm* — John R Casperson

(57) ABSTRACT

A cooled cabinet assembly for the storage of vials, beakers or the like is disclosed. The assembly comprises an insulating tray, a cooling element, and a fan. The insulating tray comprises a bottom wall and a plurality of side walls extending upwardly from a periphery of the bottom wall. The insulating tray has an open upper end and defining an insulated cavity. The cooling element is positioned in air flow communication with the insulated cavity. The fan is configured to circulate air over the cooling element and into the insulated cavity and the drip pan is positioned to capture condensate from the cooling element. In one embodiment, an inside surface of the bottom wall inclines downwardly toward a drip pan to provide for gravity flow of condensate from the cavity to the drip pan. An insulating lid is provided to close of the cabinet when not in use. Insulating bands or rings are provided for positioning on the vials upper ends to reduce heat and moisture infiltration into the cabinet.

14 Claims, 5 Drawing Sheets

(56) References Cited

U.S. PATENT DOCUMENTS

| | | | | |
|---|---|---|---|---|
| 5,689,970 | A | 11/1997 | Chopas | |
| 5,863,507 | A | 1/1999 | James | |
| 5,993,744 | A | 11/1999 | Rao et al. | |
| 6,274,091 | B1 | 8/2001 | Mohan et al. | |
| 6,361,746 | B1 | 3/2002 | Wlodarski | |
| 6,436,350 | B1 * | 8/2002 | Stanchfield et al. | 422/130 |
| 6,562,630 | B2 | 5/2003 | Bryant et al. | |
| 7,182,130 | B2 | 2/2007 | Ohki | |
| 7,232,038 | B2 * | 6/2007 | Whitney | B01L 9/06 211/74 |
| 7,258,240 | B2 * | 8/2007 | Wescott, III | B01L 9/06 206/563 |
| 8,460,622 | B2 * | 6/2013 | Motadel | B01L 9/543 211/126.1 |
| 2002/0184895 | A1 * | 12/2002 | Anderson et al. | 62/3.6 |
| 2005/0210884 | A1 * | 9/2005 | Tuskiewicz et al. | 62/3.6 |
| 2007/0151984 | A1 | 7/2007 | Baker et al. | |
| 2008/0050578 | A1 * | 2/2008 | Sinclair, Sr. | 428/318.4 |
| 2009/0064698 | A1 * | 3/2009 | Spanger | 62/280 |
| 2009/0120104 | A1 | 5/2009 | Federer | |

OTHER PUBLICATIONS

Chodosh, Daniel F., Automated Chemical Synthesis. Part 3: Temperature Control Systems, J. of Auto. Chem, vol. 5, No. 2, pp. 103-107, Apr. 1, 1983.

Yahoo Image Search Results for "vial rack" dated Dec. 29, 2009 (9 pages).

The Engineering Toolbox, Thermal Conductivity Conversion Factors, http://www.engineeringtoolbox.com/thermal-conductance-conversion-d_1334.html (2015).

The Engineering Toolbox, Resistivity from Conductivity, http://www.engineeringtoolbox.com/thermal-resistivity-d_1053.html (2015).

Professional Plastics, Thermal Properties of Plastics Materials, http://www.professionalplastics.com/professionalplastics/ThermalPropertiesofPlasticMaterials.pdf (2015).

Wikipedia, Insulation (list of insulation material), http://en.wikipedia.org/wiki/Insulation_(list_of_insulation_material) (2015).

* cited by examiner

COOLED CABINET ASSEMBLY

FIELD OF THE INVENTION

One embodiment of this invention relates to a container storage device. Another embodiment relates to a cooled container storage device. A further embodiment relates to a cooled container storage device that is air cooled and provides for removal of condensate. Another embodiment of the invention relates to a container storage device that is well suited for medical vials as the vials are kept dry, allowing for paper labeling. Another embodiment of the invention relates to caps for vials, which can be color-coded if desired.

BACKGROUND OF THE INVENTION

Health care practitioners who specialize in the treatment of allergies must routinely handle large numbers of containers, typically vials, which contain different proteins in solution. It is beneficial to keep the vials cool to prevent early denaturing of the proteins as this adversely affects safety, accuracy, effectiveness and increases costs. To facilitate this, the vials are generally positioned in vial trays, which are stacked and taken in and out of a refrigerator and laid out on a table or countertop for access, since the individual vials can be neither identified nor accessed when the trays are stacked and in the refrigerator. The stacking and unstacking and taking the trays in and out of the refrigerator is time-consuming. While the trays are out of the refrigerator, they warm up and collect condensate, which both shortens the life of the vial contents and causes the need for clean up of the collected condensate. Dampness also provides a breeding ground for bacteria, which creates a safety issue. An assembly for holding the vials so that the individual vials can be identified and accessed and which keeps the vials cool and dry and furthermore mitigates the accumulation of condensate and provides for the removal of any accumulated condensate would be very desirable.

Although the invention is described in terms of apparatus for vials, it could be applied to most any container.

OBJECTS OF THE INVENTION

It is an object of a preferred embodiment of this invention to provide a controlled climate vial cabinet assembly that can be cooled by a simple device, such as by a Peltier device.

It is another object of a preferred embodiment of this invention to provide a vial cabinet assembly that can accommodate multiple types of containers, for example, vials, beakers or syringes, multiple-well allergy testing trays, or blank trays.

It is a further object of a preferred embodiment of this invention to provide a cabinet assembly for vials that has multiple temperature sensors and the capability of displaying individual zone temperatures, total average temperature, and an audible signal in the event that a temperature becomes out of range.

It is another object of a preferred embodiment of this invention to provide a vial cabinet assembly that has an easy to clean cooled chamber, with easy access being provided by removal of the vial trays and which provides for labor-free draining and removal of condensate.

It is another object of a preferred embodiment of this invention to provide a vial cabinet assembly having a drip tray for the removal and evaporation of condensate, and a level sensor associated with the drip tray with optional audible signal in the event the liquid level becomes too high.

It is another object of a preferred embodiment of this invention to provide a vial cabinet assembly including an insulating cover for higher efficiency operation during times of limited use, such as night time, weekends, and holidays.

It is another object of a preferred embodiment of this invention to provide a vial cabinet assembly which has provision for changeably labeling the vial rows with strips of writing surface to allow accurate marking of the rows of bottles or vials.

It is another object of a preferred embodiment of this invention to provide a vial cabinet assembly in which the individual trays are stackable and nestable to facilitate storage or transport.

It is another object of a preferred embodiment of this invention to provide a vial cabinet assembly can be placed on a countertop or mounted near flush in a counter top if desired.

It is a further object of this invention to provide an insulating vial cap for color-coding the vials and for sealing the vials in the tray to prevent or mitigate heat and moisture penetration into the cabinet.

SUMMARY OF THE INVENTION

One embodiment of the invention provides a cooled cabinet assembly for the storage of vials, beakers or the like. The assembly comprises an insulating tray, a cooling element, a fan, and a drip pan. The insulating tray comprises a bottom wall and a plurality of side walls extending upwardly from a periphery of the bottom wall. The insulating tray has an open upper end and defines an insulated cavity. The cooling element is positioned in air flow communication with the insulated cavity. The fan is configured to circulate air over the cooling element and into the insulated cavity and the drip pan is positioned to capture condensate from the cooling element.

The assembly is preferably equipped with removable, stackable trays in which the vials or beakers are stored. The vials are preferably provided with insulating rings or bands near their upper ends which seal against portions of the removable trays.

In use, the caps form a vial assembly comprising a vial, a vial end closure, and an insulating ring or band. The vial has a generally cylindrical body which defines a mouth at one end and the insulating ring or band is positioned around the body near the mouth end of the vial. The vial end closure closes the mouth and seals the inside of the vial from the outside. The insulating ring or band seals against the body of the vial and when in use seals against an aperture in the tray.

DETAILED DESCRIPTION OF THE INVENTION

Figure 1:
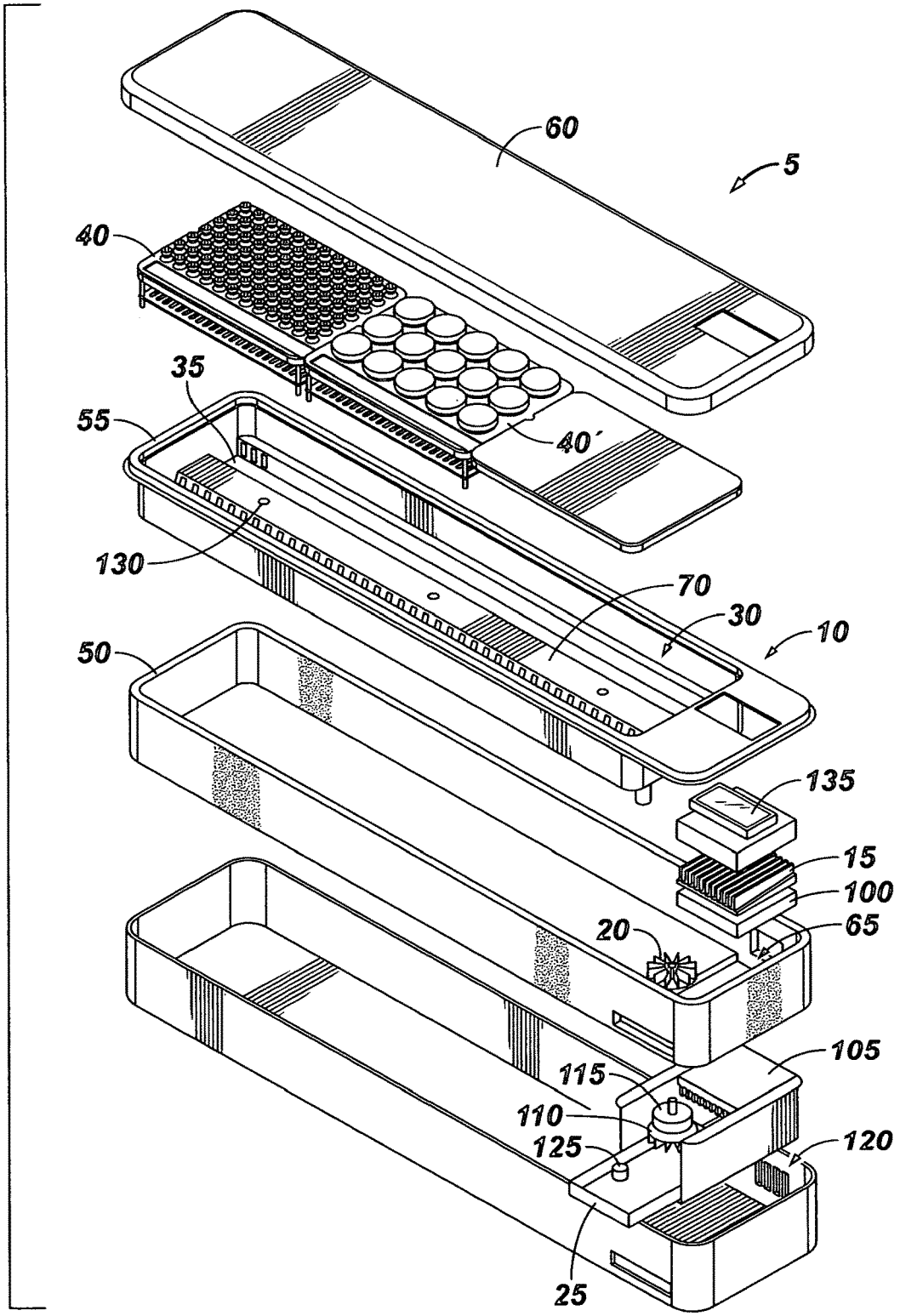
FIG. 1 is an exploded view of a cabinet assembly in accordance with an embodiment of the invention.

A cabinet assembly 5 in accordance with an embodiment of the invention is illustrated in FIG. 1. The assembly comprises an insulating tray 10, a cooling element 15, a fan 20, and a drip pan 25. The insulating tray comprises a bottom wall and a plurality of side walls extending upwardly from a periphery of the bottom wall. The insulating tray has an open upper end and defines an insulated cavity 30. The cooling element is positioned in air flow communication with the insulated cavity. The fan is configured to circulate air over the cooling element and into the insulated cavity and the drip pan is positioned to capture condensate from the cooling element. In one embodiment of the invention, an inside surface of the bottom wall 35 inclines downwardly toward the drip pan to provide for gravity flow of condensate from the cavity to the drip pan. In another embodiment, the cooling element has a downwardly inclined surface to provide draining condensate to the drip pan. In another embodiment, condensate is drained onto the hot side heat sink on the way to the drip pan, so that evaporative cooling can further improve the efficiency of the device and provide for the auto-removal of condensate.

Figure 2:
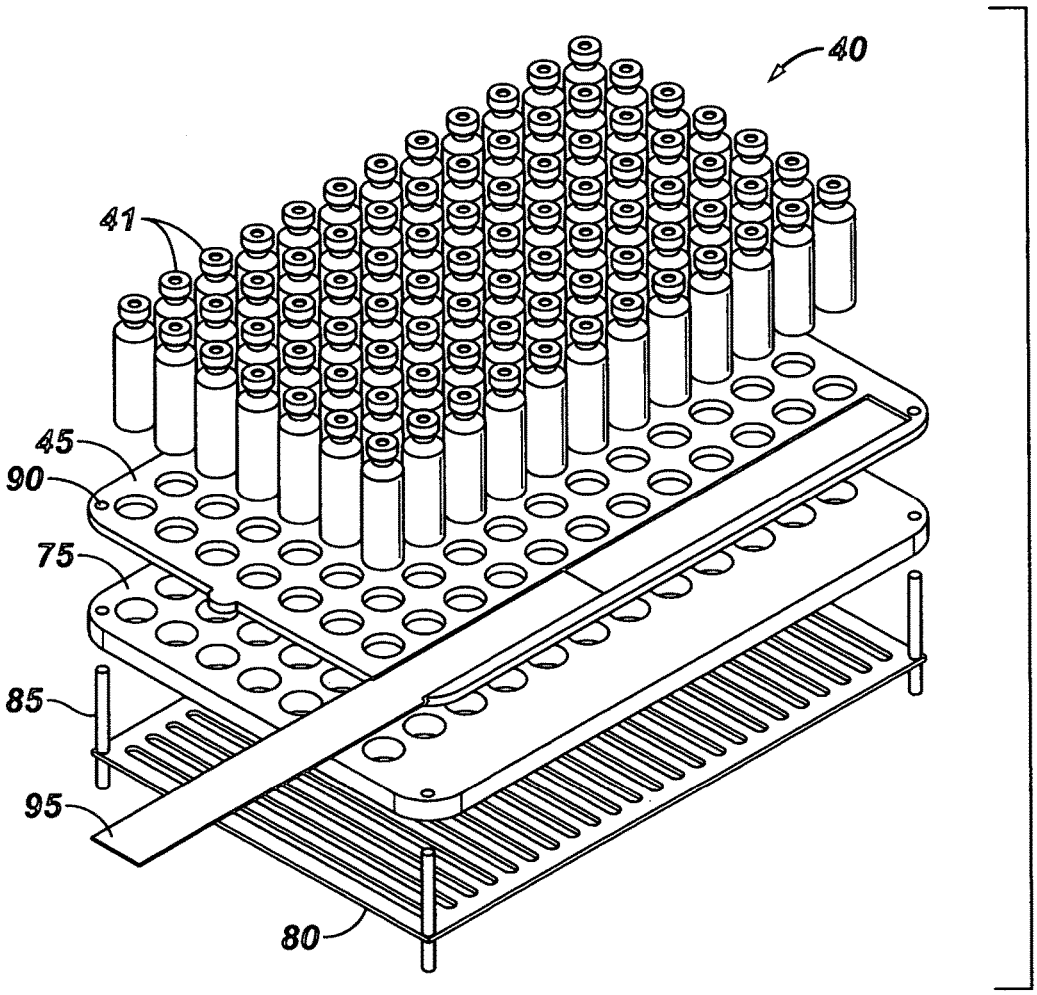
FIG. 2 is an exploded view of a vial tray assembly in accordance with an embodiment of the invention.
Figure 3:
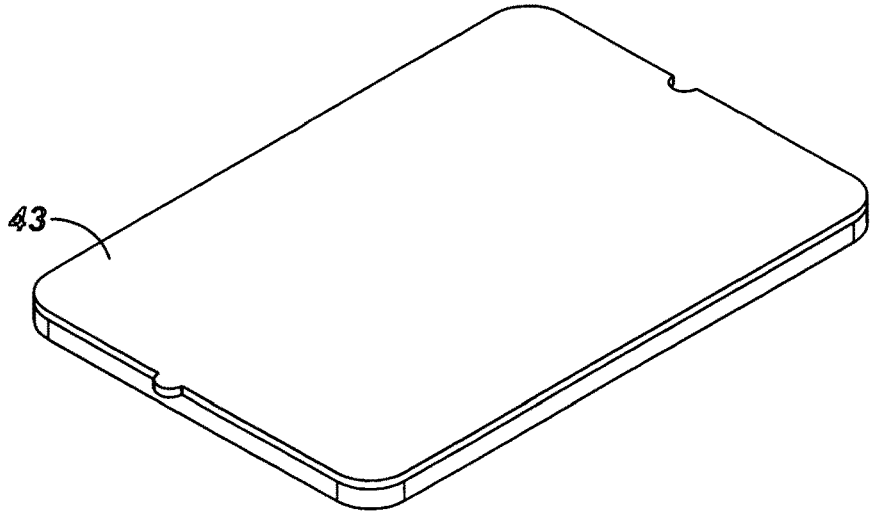
FIG. 3 is a pictorial view of an insulating panel in accordance with an embodiment of the invention.

In use, an apertured plate assembly 40, 40' is positioned in the insulating tray. In the illustrated embodiment, plate assembly 40 carries vials 41, while plate assembly 40' carries beakers 42. An apertured plate assembly which defines a plurality of sample wells typically containing refrigerated liquid allergen samples, can also be used. In the illustrated embodiment, the apertured plate assembly includes a perforated face plate 45 (see FIG. 2) which is positioned near the open upper end of the tray and is near parallel to the bottom wall. A cooled chamber is defined between the apertured plate of the plate assembly and the inside surface of the bottom wall of the insulating tray. If needed, an imperforate insulating filler plate 43 is positioned in the cabinet alongside one of the apertured plate assemblies, so that a portion of the cooled chamber is defined between the imperforate insulating filler plate and the bottom wall.

By "insulating" is meant formed of a material and/or of construction so as to have an R value of at least 2 per inch, US. Usually, the material is selected so as to have an R value in the range of R-2 to R-20 per inch, and most often in the range of R-4 to R-12 per inch. For walls, panels, etc., hollow-core construction, optionally provided with greater resistance to thermal penetration by vacuum or fiber fill can be used. However, use of insulating foam is preferred, preferably with the wall construction being of or containing hardened self-standing polymer foam, such as polystyrene, polyurethane or icynene on the order of an inch thick. More preferably, the foam is of closed cell construction. For seals, rings, tubes, gaskets, or rubbery elements benefiting from an insulating construction, an elastomeric thermoplastic such as a polyurethane or styrene-butadiene block copolymer is suitable.

The insulating tray 10 preferably includes an insulating tray body 50 having side walls and a bottom wall positioned to closely surround an inner tray liner 55. The insulating tray body preferably forms a tray-shaped cavity and a liner lines the tray-shaped cavity and forms a shallow box which is open at the upper end. The cabinet assembly preferably further comprises an insulating closure body 60 sized to completely cover the open upper end and form an insulated closed cavity.

In the illustrated embodiment of the invention, the shallow box formed by the inner tray liner is spaced apart from a first end of the tray-shaped cavity to form a chamber 65 between the inner tray liner and the first end of the tray-shaped cavity that houses the cooling element. The fan is positioned to draw air from the cooled chamber, circulate the air over the cooling element to form cooled air, and discharge the cooled air into the cooled chamber. At least one passage for flow of air from the cooling element is defined between the insulating tray body and the tray liner and leads from the chamber that houses the cooling element to a second end of the tray-shaped cavity that is opposite from the first end. See tunnel cover 70 in FIG. 1 for example. However, the cooling element can be positioned in the cooled chamber beneath the apertured plates if desired.

The apertured plate assembly preferably further comprises a perforated insulating plate or plate assembly 75 serving as substrate for the perforated face plate. The perforations of the face plate are aligned with the perforations in the insulating plate. The perforations are preferably arranged in rows and columns and are laid out in square pitch. A replaceable strip 95 is preferably slidably mounted in a track formed in the perforated face plate, for labeling the aperture rows. The strip preferably extends alongside the rows, the rows extending at a right angle from the strip. The columns are preferably made visually distinguishable when the apparatus is in use by providing the vials with caps or sleeves which are color coded a different color for each column.

In use, it is preferred that all the apertures but one be occupied by a close fitting container, generally a vial, or plug to avoid unnecessary heat and/or humidity infiltration into the insulated chamber. The insulated chamber is preferably substantially isolated from the surrounding environment when all the apertures in the plates are occupied by vials.

Figure 4:
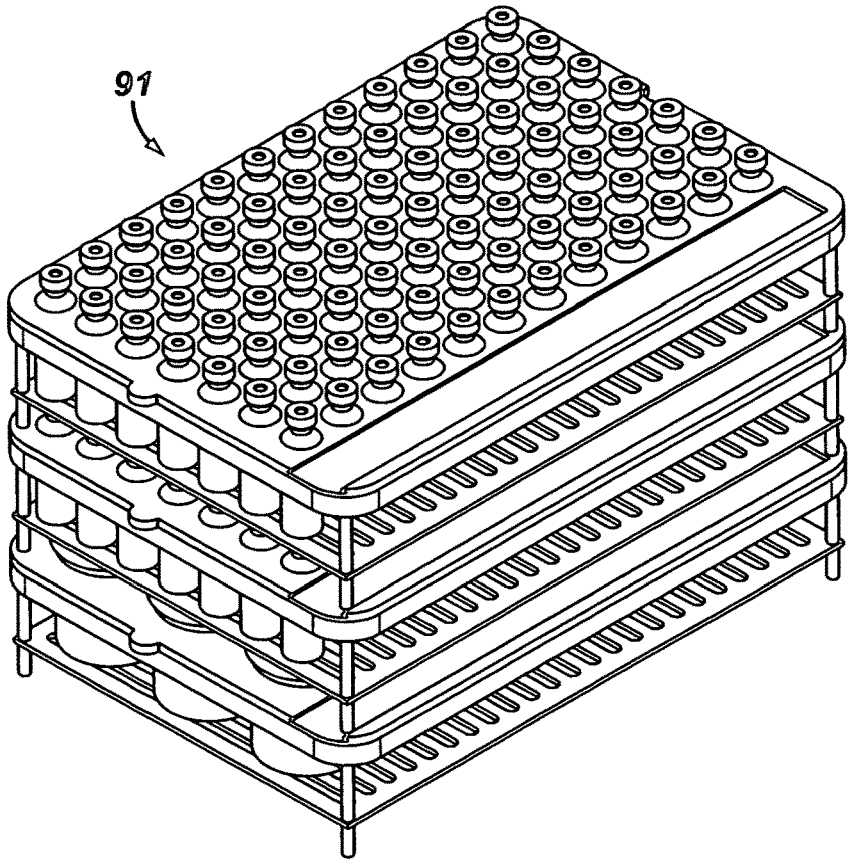
FIG. 4 is a pictorial view of registrably stacked tray assemblies in accordance with an embodiment of the invention.
Figure 5:
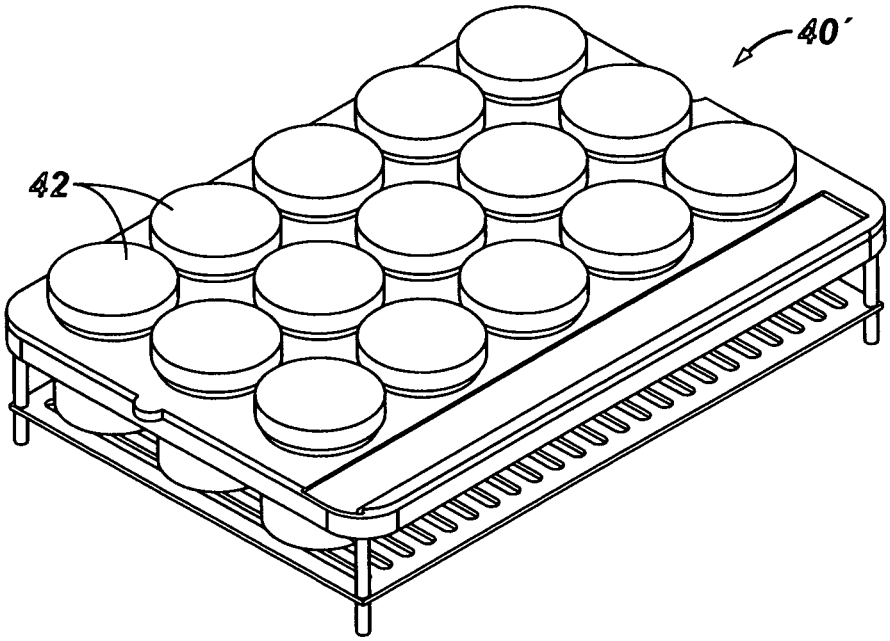
FIG. 5 is a pictorial view of a beaker tray assembly in accordance with an embodiment of the invention.
Figure 6:
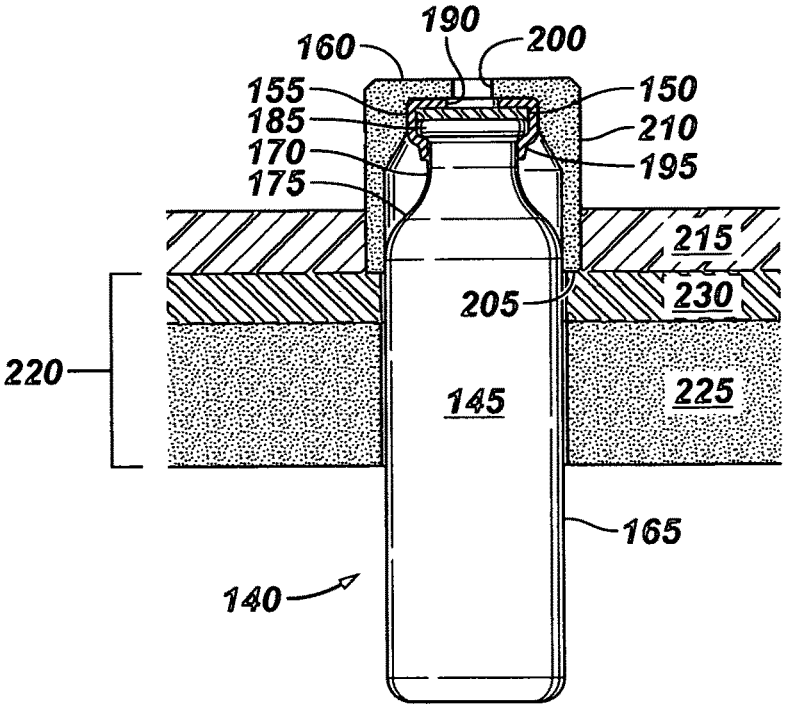
FIG. 6 is a side sectional view of a vial/insulative ring or band assembly sealingly engaged with an apertured tray.
Figure 7:
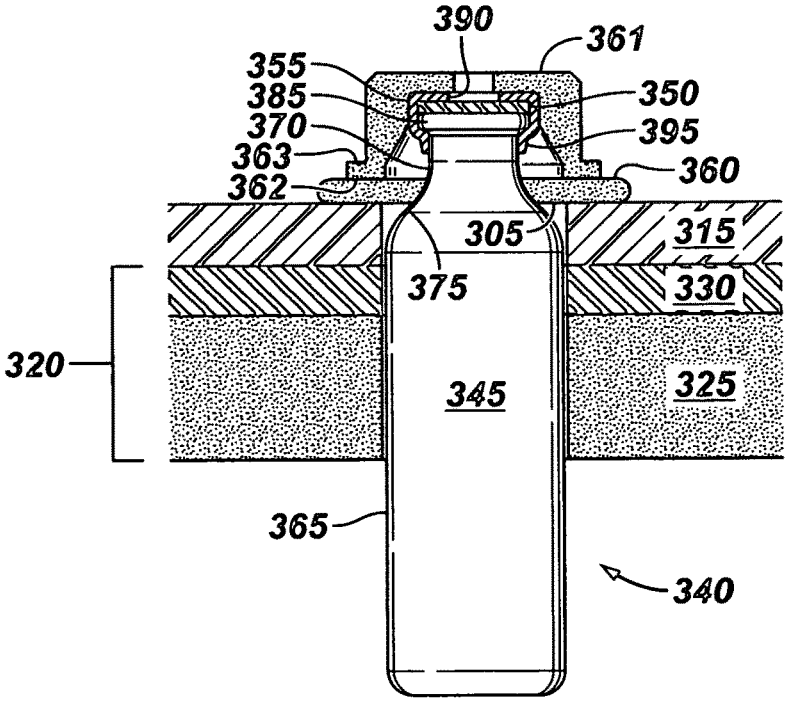
FIG. 7 is a side sectional view of another vial/insulative ring or band assembly sealingly engaged with an apertured tray.

In one embodiment of the invention, a support grate 80 is preferably positioned parallel to the perforated insulating plate. However, when vial assemblies as shown in FIG. 6 or 7 are used, the grate can be dispensed with. When used, a plurality of spacers 85 space the support grate or cabinet bottom apart from the insulating plate, and the insulating plate is positioned between the support grate and the perforated face plate. The support grate has a framework to support cylindrical objects sized to fit the perforations in the perforated face plate and the perforated insulating plate. The spacers preferably protrude beneath the support grate and can be received by upwardly facing boreholes 90 in the corners of the face plate so that the tray assemblies are registrably stackable, as shown in FIG. 4. At the end of the day, or for maintenance, the trays can be stacked into a stack 91 if desired, for example as shown in FIG. 4, and placed in a refrigerator.

In a preferred embodiment of the invention, the cooling element is a part of a Peltier cooler system. The Peltier cooler system comprises a Peltier device 100 mounted in an insulating wall. In the illustrated embodiment, the device has a cold side facing upward and a hot side facing downward. A cold side heat sink is mounted to the cold side of the Peltier device. The cold side heat sink has upwardly extending fins and constitutes the cooling element 15. A hot side heat sink 105 is mounted to the hot side of the Peltier device. The hot side heat sink has downwardly extending fins and constitutes a heating element. The fan 20 circulates air over the cold side heat sink and a hot side fan 110 circulates air over the hot side heat sink. In the illustrated embodiment, an electric motor 115 rotates both fans, although two or more motors could be used, and blowers could be used instead of fans. The drip pan for collection of condensate in the illustrated embodiment is positioned beneath the hot side heat sink.

An air inlet 120 is formed in one of side walls of the insulating tray for the admission of ambient air to the hot side fan and an air outlet (not shown) is formed in one of the side walls of the insulating tray for the exhaust of air which has passed over the hot side heat sink. The air preferably is circulated over any condensate in the drip pan prior to being exhausted.

In one embodiment of the invention, a liquid level sensor 125 is operably associated with the drip pan and an audible alarm (not shown) is electrically connected to the level sensor to sound an alarm in the event a liquid level in the drip pan exceeds a predetermined level. At least one temperature sensor 130 is positioned in the bottom wall and is selectively electrically connected to a temperature display 135 adjacent the first end of the insulating tray. An audible alarm (not shown) is preferably electrically connected to the temperature display to alarm in the event that a sensed temperature exceeds a predetermined temperature.

In another embodiment, current flow to the Peltier device is periodically reversed for a period of time sufficient to melt any accumulated ice from the cold side heat sink. For example, the current could be reversed for one minute out of each 30 minutes to prevent ice accumulation and loss of efficiency.

Power supplies and electrical lines (not shown) are provided for those components of the system requiring same.

In a preferred embodiment of the invention, the cold side heat sink has an upwardly facing surface with a downward inclination to provide for gravity flow of liquid condensate toward the drip pan. The cold side fan circulates air across the cold side heat sink in the direction of the downward inclination to assist in causing condensate flow toward the drip pan. A drain from the cold side chamber can be positioned above a portion of the hot side heat sink to assist in cooling the hot side heat sink by direct heat exchange and by evaporative cooling. The hot side fan circulates air across the hot side heat sink and then across the surface of any condensate accumulated in the drip pan.

In another embodiment of the invention, an insulating ring or band, which can be color coded, is provided for a vial. The ring or band seals against the plate assembly to reduce heat or moisture infiltration into the cooled chamber. The vial can be generally described as having a generally cylindrical body and a mouth at one end. A vial end closure is provided covering the covering the mouth of the vial and sealing an inside of the vial from an outside of the vial. The insulating ring or band surrounds the body of the vial near the mouth end and has an outside diameter which is greater than an outside diameter of the body of the vial. The ring or band is formed from a material having an R value in the range of from 2 to 20 per inch, US.

In one exemplary embodiment, with reference to FIG. 6, there is provided a vial assembly 140 comprising a vial 145, a vial end closure 150, a collar 155, and an insulating band or cap 160. The vial has a generally cylindrical body 165, a neck 170, 15' a shoulder 175 extending between the body and the neck, a mouth, and a lip 185 positioned between the mouth and the neck. The vial end closure seals the inside of the vial from the outside. The preferred end closure comprises a rubbery stopper, although a septum could be used if desired. The collar clamps the end closure in position to maintain it in sealing engagement with the vial. When a stopper used for the end closure, a portion of it will protrude into the neck of the vial. The collar has a central aperture 190 positioned over the vial end closure to permit the end closure to be punctured and liquid contained in the vial to be withdrawn and a reduced diameter lower end portion 195 engaging the outside neck of the vial. The insulating band or cap is positioned in covering relationship at least the collar side surface and defines a central aperture 200 aligned with the aperture in the collar. If desired, the band can be provided with an inwardly extending annular flange at its upper end positioned in covering relationship with the upper end of the collar to form the insulating cap. In this embodiment, the aperture defined at the upper end of the insulating cap can be of smaller diameter than the aperture of the collar. The insulating band seals against the outer body of the vial. A lower end of the insulating sleeve adjacent the body of the vial forms a downwardly facing annular wall 205. An outer surface of the lower end of the insulating sleeve forms a generally cylindrical outer surface 210 extending upwardly from the annular wall.

The above described combination is preferably structured to form a seal when used in combination with an apertured plate assembly as described herein. In one embodiment, the insulating band is rimless and tab-less on at least the lower portion of its outer surface to facilitate forming a good seal inside of an aperture. However, the band can rest against the upper surface of the perforated face plate if desired, in which case outwardly radially extending tabs, etc. will not interfere with a seal. In the illustrated embodiment, the apertured plate assembly comprises a perforated face plate 215 and a perforated insulating substrate 220 for the perforated face plate. In the illustrated embodiment, the insulating substrate is formed from a thick insulating layer 225, for example, an expanded polymer such as a polystyrene foam and a thinner low density rubbery layer 230, such as an expanded thermoplastic elastomer, for sealing snugly against the vials. The rubbery layer can be formed from an elastomeric thermoplastic such as a polyurethane or styrene-butadiene block copolymer sheet positioned between the thick insulating layer and the face plate. The insulating band can also be formed from san elastomeric thermoplastic. The perforations of the insulating plate are sized to closely accept the generally cylindrical outer surface of the vial and the band is sized to abut against a portion of the apertured plate assembly and form a secondary seal. The vial is positioned in aligned perforations in the apertured plate assembly to form a substantially air tight seal. The apertured plate assembly forms a stop for the annular shoulder of the band or cap and prevents the vial from falling through the apertured plate assembly, thus eliminating the need for the lower grate in the tray assembly. The perforated insulating substrate, and the insulating ring or band, are formed from a material having an R value in the range of from 2 to 20 per inch, preferably in the range of 4 to 12 per inch, US. The insulating band can be used over color coded caps if desired, as the color of the cap may be viewed through the end aperture. Optionally, the insulating ring or band may be formed from a transparent or translucent material so that color coded caps can be seen through them. Generally, the insulating ring or band will have a thickness (radially) in the range of 1 to 10 mm, usually in the range of 2 to 6 mm.

In another embodiment of the invention, the insulating ring or band for the vial is provided in the form of an insulating washer. The washer can be color coded if desired. The washer can be used with convention color-coded caps. With reference to FIG. 7, there is provided a vial assembly 340 comprising a vial 345, a vial end closure 350, a collar 355, and an insulating washer 360. The vial has a generally cylindrical body 365, a neck 370, a shoulder 375 extending between the body and the neck, a mouth, and a lip 385 positioned between the mouth and the neck. The vial end closure seals the inside of the vial from the outside. The preferred end closure comprises a rubbery stopper, although a septum could be used if desired. The collar clamps the end closure in position to maintain it in sealing engagement with the vial. When a stopper used for the end closure, a portion of it will protrude into the neck of the vial. The collar has a central aperture 390 positioned over the vial end closure to permit the end closure to be punctured and liquid contained in the vial to be withdrawn and a reduced diameter lower end portion 395 engaging the outside neck of the vial. The insulating washer is positioned between the collar and the body of the vial. The inside of the washer fits snugly against the outside of the vial. The washer has an outside diameter which is greater than the outside diameter of the body of the vial. A lower face of the insulating washer adjacent the body of the vial forms a downwardly facing annular wall 305. If desired, the washer can be used in conjunction with a cap 361, which can be a conventional colored cap formed from a thermoplastic such as polyethylene. The cap 361 forms an annular wall 362 at its lower end which urges against an upper end of the insulating washer. If desired, the cap can be provided with an annular flange 363 at its lower end which urges against the insulating washer. Generally, the insulating washer has a thickness (longitudinally) in the range of 1 to 10 mm, usually in the range of 2 to 6 mm.

The above described combination is preferably structured to form a seal when used in combination with an apertured plate assembly as described herein. In one embodiment, the insulating washer seals against an upper face of an apertured plate assembly. In the illustrated embodiment, the apertured plate assembly comprises a perforated face plate 315 and a perforated insulating substrate 320 for the perforated face plate. In the illustrated embodiment, the insulating substrate is formed from a thick insulating layer 325, for example, an expanded polymer such as polystyrene foam and a thinner low-density rubbery layer 330 such as an expanded thermoplastic elastomer for sealing snugly against the vials. The rubbery layer 330 is typically an elastomeric thermoplastic such as a polyurethane or styrene-butadiene block copolymer sheet positioned between the thick insulating layer and the face plate. The perforations of the insulating plate are sized to closely accept the generally cylindrical outer surface of the vial and the washer is sized to abut against the face plate surround the aperture and form a secondary seal. The vial is positioned in aligned perforations in the apertured plate assembly to form a substantially air tight seal. The apertured plate assembly forms a stop for the insulating washer and prevents the vial from falling through the apertured plate assembly, thus eliminating the need for the lower grate. The cap, when present, stiffens the washer. The perforated insulating substrate, and the insulating washer, are formed from a material having an R value in the range of from 2 to 20 per inch, preferably in the range of 4 to 12 per inch, US. The insulating washer doesn't interfere with the function of the color coded caps.

While certain preferred embodiments have been described herein, the invention is not to be construed as being so limited, except to the extent that such limitations are found in the claims.

What is claimed is:

1. A cabinet assembly comprising an insulating tray body having side walls and a bottom wall constructed to provide insulation of at least R-2 per inch, said insulating tray body having an open upper end, wherein the insulating tray body defines a tray-shaped cavity, an insulating closure body sized to completely cover the open upper end of insulating tray and form an insulated closed cavity, said insulating closure body constructed to provide insulation of at least R-2 per inch, a liner lining the tray-shaped cavity and forming a shallow box which is open at the upper end and has a bottom wall, a cooling element positioned in air flow communication with the tray-shaped cavity, a fan to circulate air over the cooling element and into the tray-shaped cavity, and a drip pan positioned beneath the cooling element to capture condensate from the cooling element, wherein an inside surface of the bottom wall of the liner inclines downwardly toward the drip pan to provide for gravity flow of condensate from the cavity to the drip pan, an apertured plate assembly positioned in the liner, said apertured plate assembly including a perforated face plate positioned near the open upper end of the liner and near parallel to the bottom wall and a perforated insulating plate serving as substrate for the perforated face plate, the perforations of the face plate being aligned with the perforations in the insulating plate, the perforated insulating plate being formed from a material having an R value in the range of from 2 to 20 per inch, wherein a cooled chamber is defined between the perforated insulating plate of the plate assembly and the inside surface of the bottom wall of the liner.

2. The cabinet assembly as in claim 1 wherein the insulating tray body and the insulating closure body comprise expanded foam.

3. The cabinet assembly as in claim 1 wherein the fan is positioned to draw air from the cooled chamber, circulate the air over the cooling element to form cooled air, and discharge the cooled air into the cooled chamber.

4. The cabinet assembly in claim 1 wherein the apertured plate assembly further comprises a support grate positioned parallel to the perforated insulating plate, the insulating plate being positioned between the support grate and the perforated face plate, and a plurality of spacers to space the support grate apart from the insulating plate, wherein the support grate has a framework to support cylindrical objects sized to fit the perforations in the perforated face plate and the perforated insulating plate.

5. The cabinet assembly as in claim 4 further comprising a replaceable strip slidably mounted in a track formed in the perforated face plate, for labeling the aperture rows.

6. The cabinet assembly as in claim 1 further comprising an imperforate insulating filler plate positioned in the tray assembly alongside the apertured plate assembly, a portion of the cooled chamber being defined between the imperforate insulating filler plate and the bottom wall, wherein the imperforate insulating filler plate has an R-value of at least 2.

7. The cabinet assembly as in claim 1 further comprising a plurality of vial assemblies carried by the apertured plate assembly, one vial assembly per aperture, wherein each vial assembly has a generally cylindrical vial body having a mouth at one end, and a vial end closure covering the covering the mouth of the vial body and sealing an inside of the vial body from an outside of the vial body, each vial assembly further comprising an insulating ring or band surrounding the vial body near the mouth, said insulating ring or band having an outside diameter which is greater than an outside diameter of the vial body, and being formed from a material having an R value in the range of from 2 to 20 per inch, wherein the generally cylindrical body of each vial is closely received by an aperture of the apertured plate assembly and the insulating ring or band is positioned against the perforated face plate and forms a substantially air tight seal.

8. A cabinet assembly comprising an insulating tray body having side walls and a bottom wall constructed to provide insulation of at least R-2 per inch, said insulating tray body having an open upper end, wherein the insulating tray body defines a tray-shaped cavity, a liner lining the tray-shaped cavity and forming a shallow box which is open at the upper end and has a bottom wall, a cooling element positioned in air flow communication with the tray-shaped cavity, a fan to circulate air over the cooling element and into the tray-shaped cavity, and a drip pan positioned beneath the cooling element to capture condensate from the cooling element, wherein an inside surface of the bottom wall of the liner inclines downwardly toward the drip pan to provide for gravity flow of condensate from the cavity to the drip pan, an apertured plate assembly positioned in the liner, said apertured plate assembly including a perforated face plate positioned near the open upper end of the liner and near parallel to the bottom wall and a perforated insulating plate serving as substrate for the perforated face plate, the perforations of the face plate being aligned with the perforations in the insulating plate, the perforated insulating plate being formed from a material having an R value in the range of from 2 to 20 per inch, wherein a cooled chamber is defined between the perforated insulating plate of the plate assembly and the inside surface of the bottom wall of the liner, wherein the cooling element is a part of a Peltier refrigeration system, said Peltier refrigeration system comprising a Peltier device mounted in an insulating wall, said device having a cold side facing upward and a hot side facing downward, a cold side heat sink mounted to the cold side of the Peltier device, said cold side heat sink having upwardly extending fins and constituting the cooling element, a hot side heat sink mounted to the hot side of the Peltier device, said hot side heat sink having downwardly extending fins and constituting a heating element, a cold side fan to circulate air over the cold side heat sink, and flow cooled air into the cooled chamber, and a hot side fan to circulate air over the hot side heat sink.

9. The cabinet assembly as in claim 8 further comprising a liquid level sensor operably associated with the drip pan, and an audible alarm electrically connected to the level sensor to alarm in the event a liquid level in the drip pan exceeds a predetermined level.

10. The cabinet assembly as in claim 8 further comprising a plurality of temperature sensors positioned in the bottom wall, said temperature sensors being selectively electrically connected to a temperature display.

11. The cabinet assembly as in claim 10 further comprising an audible alarm electrically connected to the temperature display to alarm in the event that a sensed temperature exceeds a predetermined temperature.

12. The cabinet assembly as in claim 8 wherein the cold side heat sink has an upwardly facing surface with a downward inclination to provide for gravity flow of liquid condensate toward the drip pan.

13. The cabinet assembly as in claim 12 wherein the cold side fan circulates air across the cold side heat sink in the direction of the downward inclination.

14. The cabinet assembly as in claim 8 wherein the hot side fan circulates air across the hot side heat sink and then across the surface of any condensate accumulated in the drip pan.

* * * * *